US006332410B1

(12) United States Patent
Freiermuth et al.

(10) Patent No.: US 6,332,410 B1
(45) Date of Patent: Dec. 25, 2001

(54) GRATE FOR INCINERATION PLANTS

(75) Inventors: Friedrich Freiermuth, Cumbajá-Quito (EC); Max Künzli, Boswil (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/372,829

(22) Filed: Aug. 12, 1999

(30) Foreign Application Priority Data

Aug. 19, 1998 (EP) ..... 98810804

(51) Int. Cl.[7] ..... F23H 7/08; F23H 7/10; F23H 1/02; F23H 3/00; F23K 3/08

(52) U.S. Cl. ..... 110/281; 110/328; 110/268; 110/278; 110/288; 110/298; 126/152 R; 126/163 R; 126/181; 126/175

(58) Field of Search ..... 110/327, 328, 110/267, 268, 278, 281, 288, 298; 126/152, 152 R, 163 R, 181, 174, 175

(56) References Cited

U.S. PATENT DOCUMENTS

| | | | | |
|---|---|---|---|---|
| 831,177 | * | 9/1906 | McClave | 110/328 |
| 3,399,662 | * | 9/1968 | Holstein et al. | 126/176 |
| 3,460,491 | * | 8/1969 | Bryk | 110/69 |
| 4,537,139 | * | 8/1985 | Esser | 110/276 |
| 4,901,653 | * | 2/1990 | Baltzinger | 110/281 |
| 5,241,916 | * | 9/1993 | Martin | 110/348 |
| 5,538,128 | * | 7/1996 | Stierll | 198/773 |
| 5,913,274 | * | 6/1999 | Kunzli et al. | 110/328 |
| 6,024,031 | * | 2/2000 | Stiefel | 110/281 |

FOREIGN PATENT DOCUMENTS

| | | |
|---|---|---|
| 637198 | 7/1983 | (CH) . |
| 343719 | 11/1921 | (DE) . |
| 462953 | 7/1928 | (DE) . |
| 2547155 | 9/1976 | (DE) . |
| 0757206A2 | 2/1997 | (EP) . |
| 0844438A2 | 5/1998 | (EP) . |
| 376389 | 7/1932 | (GB) . |
| WO96/29544 | 9/1996 | (WO) . |

OTHER PUBLICATIONS

Thermische Abfallbehandlung, Thome–Kozmiensky, 1994, pp. 156, 159.

* cited by examiner

*Primary Examiner*—Henry Bennett
*Assistant Examiner*—K. B. Rinehart
(74) *Attorney, Agent, or Firm*—Burns, Doane, Swecker & Mathis, L.L.P.

(57) ABSTRACT

The invention relates to a grate for incineration plants for the incineration of combustible material, in particular refuse, comprising at least one grate track, which is composed of fixed and movable grate-lining rows, which are arranged alternately in the direction of flow of the combustible material and have a number of grate-lining units lying side by side, the grate-lining units being connected in the region of their rear end to fixed and movable grate-lining carriers respectively and moving with their front end on or over the following grate-lining unit, and a drive being assigned to the movable grate-lining units, which drive has a torsion bar led out of the underblast region. The grate is distinguished by the fact that the movable grate-lining carriers are firmly connected via a torsion lever to the torsion bar and thus have a common pivoting point with the associated torsion bar, and that the grate-lining units are designed in a circular segment shape in such a way that the non-linear movement, resulting from the drive mechanism, of the movable grate-lining units is compensated for.

5 Claims, 3 Drawing Sheets

GRATE FOR INCINERATION PLANTS

BACKGROUND OF THE INVENTION

1. Field of the Invention

The present invention relates to a grate for incineration plants for the incineration of combustible material, in particular refuse, comprising at least one grate track, which is composed of fixed and movable grate-lining rows, which are arranged alternately in the direction of flow of the combustible material and have a number of grate-lining units lying side by side, the grate-lining units being connected in the region of their rear end to fixed and movable grate-lining carriers respectively and moving with their front end on or over the following grate-lining unit, and a drive being assigned to the movable grate-lining units.

2. Discussion of Background

Firing grates serve to incinerate combustible material and at the same time transport it further. In particular for incineration plants for refuse, forward-feed, reversed-feed and opposed overfeed grates having fixed and movable grate-lining units are known. The movement of the movable grate-lining rows is effected essentially by virtue of the fact that a plurality of rows of grate-lining units are combined and are actuated by a single drive. It would be expensive to move each row individually (K. J. Thomé-Kozmiensky: Thermische Abfallbehandlung. EF-Verlag für Energie- und Umwelttechnik GmbH, 2nd edition, 1994, pages 156–159).

Thus, for example in DE-B 25 47 155, the movable elements of the grate-lining drives are arranged in the region of the underblast. The result of all this is that the possible movements of the grate-lining units are greatly restricted and thus ideal adaptation to the burn-up behavior of the combustible material cannot be achieved. Due to a plurality of moving grate-lining rows being combined in terms of the drive, the grate cannot be subdivided into a sufficient number of air zones (underblast zones, i.e. chambers which are arranged under the grate lining and through which some of the combustion air and, in the case of air-cooled grates, the cooling air is supplied to the grate-lining units) in order to react in an optimum manner to the various firing states on the grate.

According to CH 637 198, in order to adapt the movement of the movable grate-lining rows to the burnup behavior of the combustible material, a drive which has a pivoted linkage having a pivotable torsion bar led out of the underblast region is used for the grate, the pivoted linkage being arranged with the drive outside the underblast region. In this case, a rectilinear-guide device is assigned to the torsion bar and causes additional translational motion of the torsion bar, this translational motion permitting a linear movement of the grate-lining units. A disadvantage with this prior art is that the solution is relatively complicated, since multiple weight transfer has to be effected.

To incinerate refuse having a high calorific value, water-cooled grate systems (EP 0 757 206 A1, EP 0 844 438) are used, so that the useful life of the grate-lining units is not reduced on account of the high thermal loading. The attachment of the supply and discharge hoses for the liquid cooling medium causes very restricted space conditions. Since the hoses perform up to $5\times10^5$ movements per year, leakages often occur. In addition, liquid metals damage the supply and discharge hoses of the cooling medium, and a build-up occurs, which together with the aggressive atmosphere reduces the plant availability. If, in the event of a cooling-hose leakage, a refuse-incineration plant is not shut down for reasons of cost, an acute personnel hazard has to be tolerated during the removal of the leakage.

SUMMARY OF THE INVENTION

Accordingly, one object of the invention, in attempting to avoid these disadvantages, is to design a novel grate for incineration plants, in particular for the incineration of refuse, in such a way that the drive of the grate-lining units is simplified compared with the prior art, the plant availability is always ensured and ideal adaptation of the movement of the movable grate-lining rows to the burn-up behavior of the respective combustible material is achieved.

According to the invention, a grate for the incineration of combustible material includes at least one grate track. The grate track is composed of fixed and movable grate-lining rows, which are arranged alternately in the direction of flow of the combustible material and have a plurality of grate-lining units arranged side by side. The fixed grate-lining units being connected, in a rear end region of the fixed grate-lining units, to fixed grate lining carriers. The movable grate-lining units being connected, in a rear end region of the movable grate-lining units, to movable grate-lining carriers.

The advantages of the invention consist in the fact that the drive of the movable grate-lining units is substantially simplified. Each row may be driven individually or a plurality of grate-lining rows may have a combined drive. It is important that the drive is effected outside the underblast zone and thus no restrictions with regard to the mobility of the grate-lining rows have to be accepted.

It is especially expedient if the torsion bar, the torsion lever and the grate-lining carrier of the movable grate-lining units as well as the grate-lining carrier of the fixed grate-lining units form the supporting structure for the supply and discharge of a cooling medium, preferably liquid cooling medium. As a result, the separate hoses for the supply and discharge of the cooling medium are omitted in the underblast zone, so that there is more space available in the underblast zones. On the other hand, leakages of the cooling medium are avoided and thus the plant availability is increased.

Furthermore, it is of advantage if the grate-lining units are connected in an essentially fixed manner to the inflow distributor and the outflow collector by means of metal pipes or hoses and the pipes or hoses are arranged at the rear end of the grate-lining units. Consequently, on the one hand, the wear which occurs at the front bearing surface (abrasion point) of the grate-lining units can be compensated for and, on the other hand, due to the omission of suspended hoses, leakages are prevented and thus the plant availability is increased again.

Finally, it is advantageous if there is an autonomous air zone between two adjacent fixed grate-lining carriers. The grate may therefore be subdivided into a sufficiently large number of air zones in order to be able to react in an optimum manner to the various firing states on the grate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a water-cooled and an air-cooled grate for a refuse-incineration plant, wherein.

DESCRIPTION OF THE PREFERRED EMBODIMENTS

Figure 1:
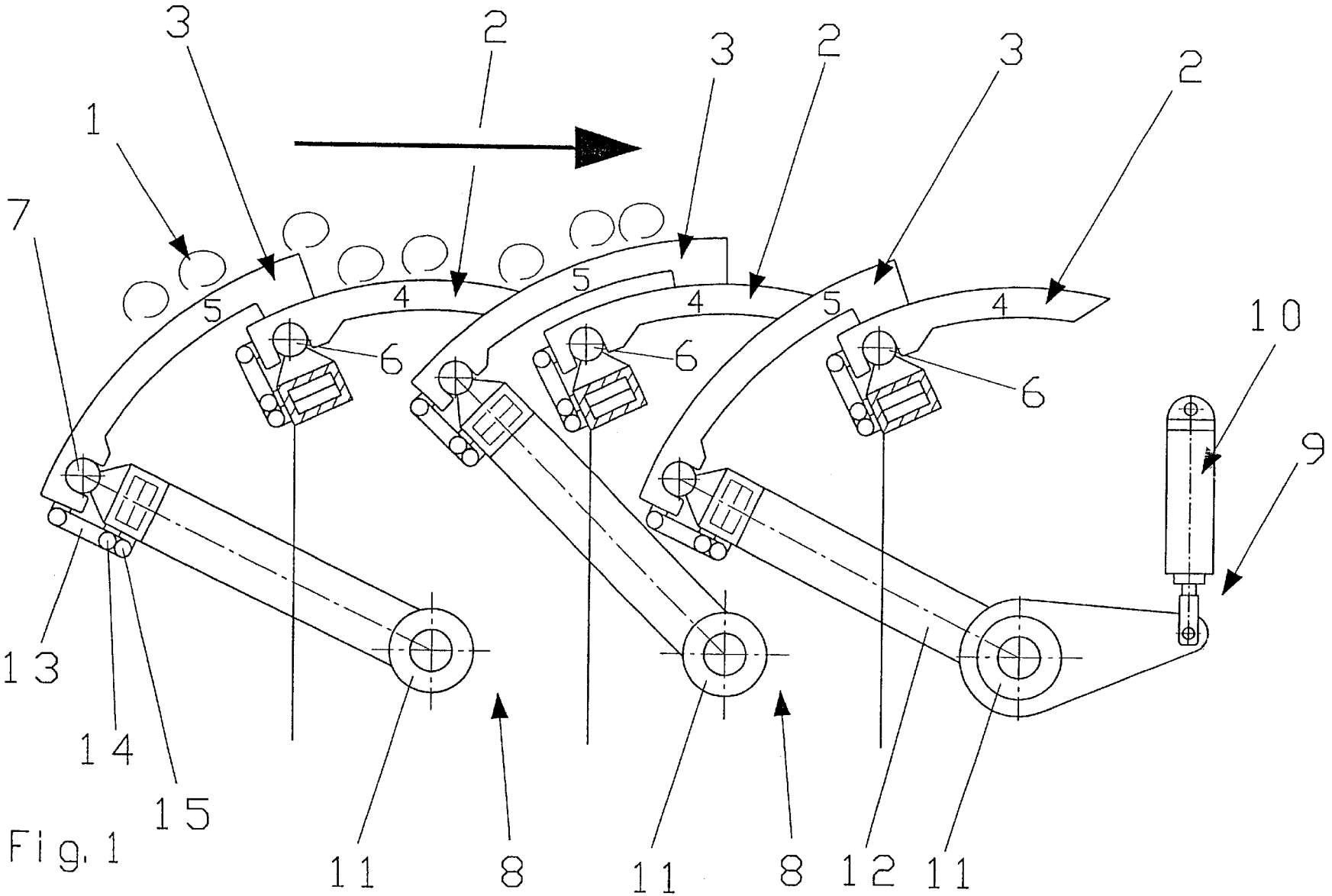
FIG. 1 shows a schematic partial longitudinal section of a water-cooled grate according to the invention.

Referring now to the drawings, wherein like reference numerals designate identical or corresponding parts throughout the several views and only the elements essential for the understanding of the invention are shown, FIG. 1 shows a partial longitudinal section of a water-cooled grate according to the invention for incineration plants for the incineration of combustible material 1, in particular refuse. Part of a grate track is depicted, and this grate track consists of fixed grate-lining rows 2 and movable grate-lining rows 3 arranged alternately in the direction of flow of the combustible material 1 (indicated by the arrow). The grate-lining rows 2, 3 are each composed of a number of grate-lining units 4, 5 lying side by side and coupled to one another. The grate-lining units 4, 5 may be, for example, so-called grate bars, which are relatively narrow, but they may also be so-called grate plates, of which, for example, only 3 pieces per grate-lining row are arranged side by side. In the extreme case, the grate plate may also extend over the entire width of the grate track or the grate. In the region of their rear end, the grate-lining units 4 are connected to fixed grate-lining carriers 6 and the grate-lining units 5 are connected to movable grate-lining carriers 7. The grate-lining units 5 move with their front end on or over the following fixed grate-lining unit 4. Formed under the grate-lining units 4, 5 are underblast zones 8, through which some of the combustion air, the so-called primary air, flows. The primary air then flows through openings in or between the grate-lining units 4, 5 into the combustion space lying above the grate.

Assigned in each case to the movable grate-lining rows 3 or movable grate-lining carriers 7 is a drive 9, which consists of a hydraulic cylinder 10, which is placed outside the underblast zone 8 and is connected to a torsion bar 11. Due to the arrangement of the cylinder 10 outside the underblast zone 8 and due to the individual drive of the grate-lining rows 3, it is possible to subdivide the grate into a sufficiently large number of air zones 8, a factor which permits optimum adaptation to the various firing states on the grate. There is in each case an autonomous underblast zone 8 between two adjacent fixed grate-lining carriers 6.

Attached to the torsion bar 11 is a torsion lever 12, which is firmly connected at its other end (the top end) to the movable grate-lining carrier 7. The movable grate-lining carrier 7 therefore has a common pivoting point with the associated torsion bar 11.

According to the invention, the grate-lining units 4, 5 are designed in a circular-segment shape in such a way that the non-linear movement resulting from the drive mechanism is compensated for.

In the water-cooled grate according to FIG. 1, the torsion bar 11, the torsion lever 12 and the grate-lining carrier 7 of the movable grate-lining units 5 and the grate-lining carrier 6 of the fixed grate-lining units 4 form the supporting structure for the supply and discharge of the liquid cooling medium (water), which flows through and cools the grate-lining units 4, 5 and thus prolongs the useful life. The grate-lining units 4, 5 are connected in an essentially fixed manner to the inflow distributor 14 and the outflow collector 15 by means of metal pipes or hoses 13, the metal pipes 13 being arranged at the rear end of the grate-lining units 4, 5. As a result, the wear which occurs at the end of the grate-lining units 4, 5 is compensated for. Due to the omission of the suspended hoses (prior art), leakages are largely revented and thus the plant availability is increased.

It is of course also possible to operate the water-cooled grate shown in FIG. 1 by means of air cooling by the cooling water being replaced by cooling air.

Figure 2:
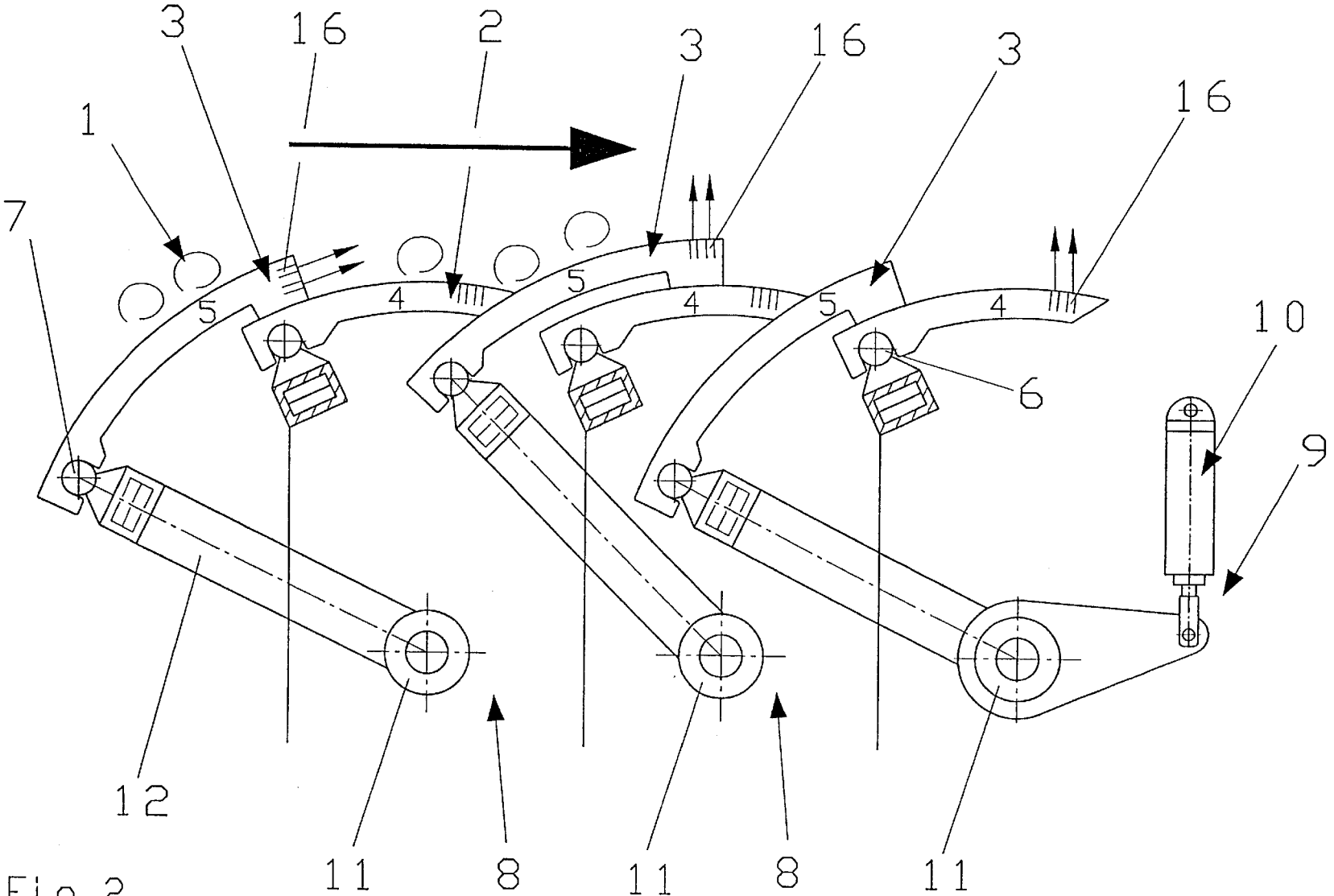
FIG. 2 shows a schematic partial longitudinal section of an air-cooled grate according to the invention.

FIG. 2 shows a further exemplary embodiment. In contrast to the first exemplary embodiment, it is not a water-cooled grate which is shown but rather an air cooled grate for the incineration of combustible material 1, preferably refuse. The movable grate-lining carriers 7 are again firmly connected via a torsion lever 12 to the torsion bar 11, again coupled to a drive 9 individually driving each grate-lining row 3, and therefore have a common pivoting point with the associated torsion bar 11. As in the first exemplary embodiment, fixed and movable grate-lining rows 2, 3, which consist of grate-lining units 4, 5 lying side by side, are arranged alternately in the direction of flow of the refuse 1. Both the fixed grate-lining units 4 and the movable grate-lining units 5 are designed in a circular-segment shape. The non-linear movement, resulting from the drive mechanism, of the movable grate-lining units 5 is compensated for by this special shape of the grate-lining units.

The air from the underblast zones 8 is first of all used to cool the grate-lining units 4, 5 by virtue of the fact that it flows, for example, through passages in the grate-lining units 4, 5 and is then introduced into the combustion space via nozzles 16, where it serves as primary combustion air. In the present embodiment, the nozzles are arranged at the front end of the grate-lining units 4, 5.

In the embodiment variant according to FIG. 2, the torsion bar 11, the torsion lever 12 and the grate-lining carriers 7 do not serve as supporting structure for the supply and discharge of the cooling medium, and there are also no pipes or hoses attached to the rear end of the grate-lining units. However, due to the individual drive 9 attached outside the underblast zone 8 and the special shape of the grate-lining units 4, 5, it is also possible here to subdivide the grate into a sufficiently large number of autonomous air zones and optimize the incineration of the refuse 1.

The invention is of course not restricted to the exemplary embodiments described. Thus, for example, a plurality of grate-lining units 3 may also have a combined drive. Since the drive is considerably simpler compared with the known prior art, the combustion can be improved in this case too.

Figure 3:
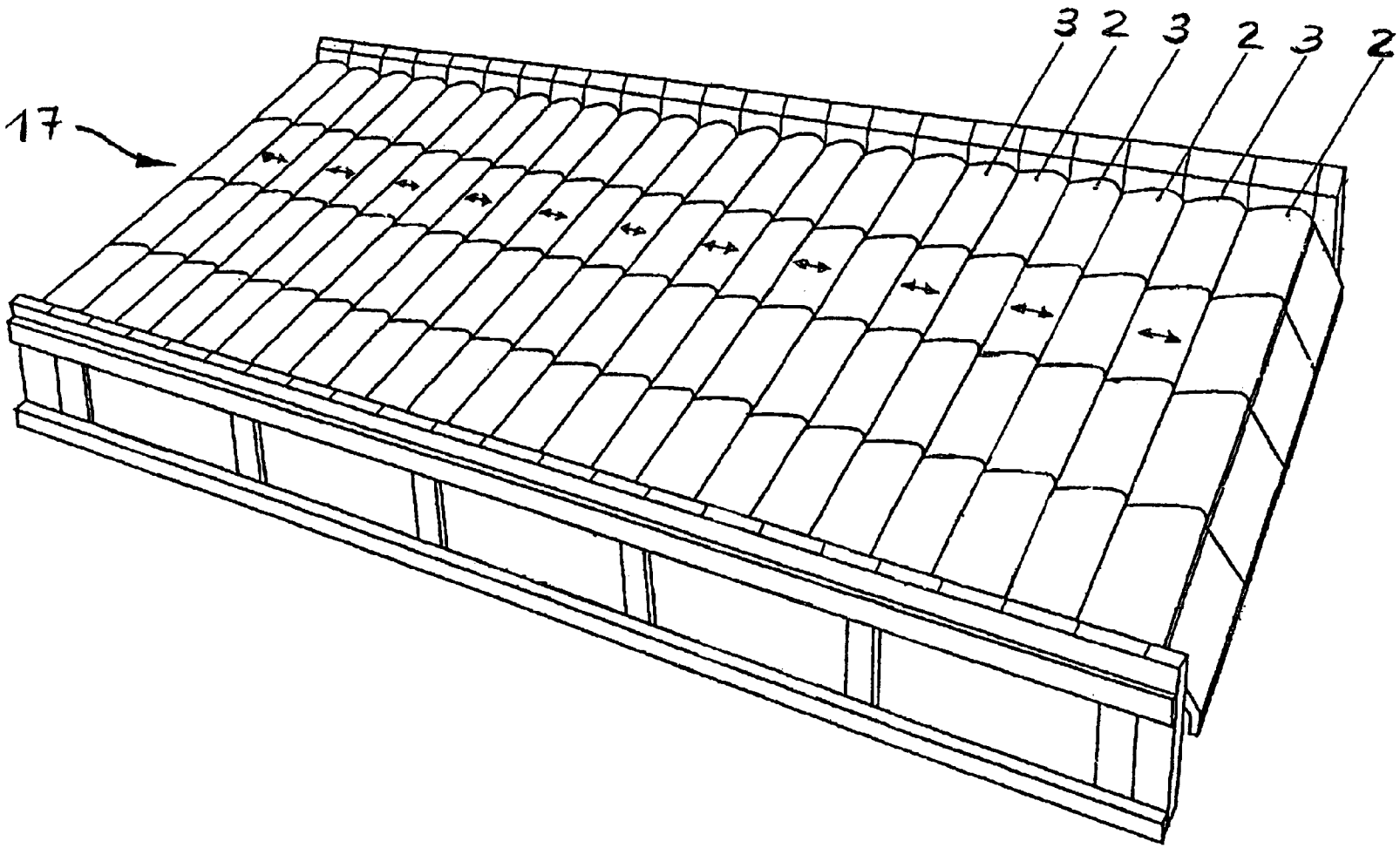
FIG. 3 illustrates a perspective view of an exemplary embodiment of the present invention.

FIG. 3 illustrates a perspective view of an exemplary embodiment of the present invention. As shown, the grate track 17 includes a plurality of fixed grate-lining rows 2 and moveable grate-lining rows 3. Referring to amended FIG. 2, the moveable grate-lining rows 3 have a drive 9 which is coupled to and drives each of the moveable grate line carriers 7.

Obviously, numerous modifications and variations of the present invention are possible in light of the above teachings. It is therefore to be understood that, within the scope of the appended claims, the invention may be practiced otherwise than as specifically described herein.

What is claimed:

1. A grate for incineration plants for the incineration of combustible material, comprising:

a grate track having a plurality of grate lining units, a plurality of the grate lining units being fixed relative to the grate track, and a plurality of grate lining units being movable relative to the grate track, the grate lining units having a circular segment shape with a support surface for supporting combustible material, the fixed grate having units being mounted in a fixed carrier at a rear end of the fixed grate, and the movable grate lining units being mounted in a movable carrier at a rear end of the movable grate lining units; the movable grate lining units having a front end of the movable grate lining units engaging the support of an adjacent fixed grate lining unit, the grate track including an underblast zone for supplying combustion air at the support surfaces of the grate lining units, each of the movable grate lining units including a torsion lever and a torsion bar, the torsion bar extending parallel to the axis of curvature of the movable grate lining units and the torsion lever extending between the torsion bar and the movable carrier, the torsion bar being located in the underblast zone and a hydraulic cylinder located outside the underblast zone, the hydraulic cylinder being connected with the torsion bar to rotate the torsion bar upon actuation of the hydraulic cylinder whereby the non-linear movement of the movable grate lining units is compensated for by the circular segment shape.

2. The grate as claimed in claim 1, wherein the torsion bar, the torsion lever and the grate-lining carrier of the movable grate-lining units as well as the grate-lining carrier of the fixed grate-lining units form the supporting structure for the supply and discharge of a cooling medium.

3. The grate as claimed in claim 1 wherein the grate-lining units are connected in a fixed manner to an inflow distributor and an outflow collector by means of metal pipes or hoses.

4. The grate as claimed in claim 3, wherein the hoses are arranged at the rear end of the grate-lining units.

5. The grate as claimed in claim 3, wherein the metal pipes are arranged at the rear end of the grate-lining units.

* * * * *